US005415419A

United States Patent [19]

Bourque

[11] Patent Number: 5,415,419

[45] Date of Patent: May 16, 1995

[54] BRAKING SYSTEM FOR IN-LINE SKATES

[75] Inventor: René Bourque, Laval, Canada

[73] Assignee: Canstar Sports Group Inc., Ville Mont Royal, Canada

[21] Appl. No.: 171,740

[22] Filed: Dec. 22, 1993

[51] Int. Cl.[6] ..... A63C 17/14

[52] U.S. Cl. ..... 280/11.2; 280/11.22; 188/2 D

[58] Field of Search ..... 280/11.2, 11.22, 11.36; 188/2 D, 17, 70 R, 72.1, 72.9

[56] References Cited

U.S. PATENT DOCUMENTS

| | | | |
|---|---|---|---|
| 920,848 | 5/1909 | Eubank, Jr. | 280/11.2 X |
| 1,402,010 | 1/1922 | Ormiston | 280/11.36 X |
| 1,497,224 | 6/1924 | Ormiston | 280/11.2 |
| 1,801,205 | 4/1931 | Mirick | 280/11.2 |
| 3,767,220 | 10/1973 | Peterson | 280/11.2 X |
| 5,171,032 | 12/1992 | Dettmer | 280/11.2 |
| 5,211,409 | 5/1993 | Mitchell et al. | 280/11.2 |
| 5,226,673 | 7/1993 | Cech | 188/2 D X |
| 5,232,231 | 8/1993 | Cartsmith | 280/11.2 |
| 5,236,058 | 8/1993 | Yamet et al. | 280/11.2 X |
| 5,253,882 | 10/1993 | Mitchell | 280/11.2 |
| 5,351,974 | 10/1994 | Cech | 280/11.2 |

FOREIGN PATENT DOCUMENTS

| | | | |
|---|---|---|---|
| 0567948 | 11/1993 | European Pat. Off. | 280/11.2 |
| 2906725 | 9/1980 | Germany | 280/11.2 |

*Primary Examiner*—Brian L. Johnson
*Attorney, Agent, or Firm*—Armstrong, R. Craig

[57] ABSTRACT

A braking system for an in-line skate for use with in-line skates having a chassis and boot assembly and a cuff pivotally mounted thereon, preferably including a plate secured to the cuff at one of the pivot points, to rotate relative to the boot with rotation of the cuff. A cable is attached to the plate a short distance from the pivot point, and is routed to lead rearwardly from the lower edge of the plate and thence through a cable housing connected to the boot and chassis near the heel area, and thence forwardly to the area of the wheels. At least one brake assembly is connected to the cable and is configured such that braking action is initiated when the cable is pulled by rearward rotation of the cuff relative to the chassis/boot assembly.

6 Claims, 5 Drawing Sheets

BRAKING SYSTEM FOR IN-LINE SKATES

BACKGROUND OF THE INVENTION

This invention relates to in-line skates and specifically to a braking system for the same. The invention could also be readily adapted to conventional roller skates, if desired.

In-line skating has become very popular as a sport and recreational activity. Associated sports such as in-line hockey and competitive in-line racing have transformed in-line skating from a casual hobby into a rigorous sporting event. This transformation has increased the need for high-performance in-line skates.

For skaters at all levels of expertise, there is a particular need for improved braking systems. By far the most common braking arrangement today is a heel brake. i.e. a brake pad mounted off the back of one or both skates. The skater brings the brake pad into contact with the ground by raising the toe of the skate to rotate it about the rear wheel and pressing down at the heel. Other known but less common braking arrangements involve using brake shoes to bring brake pads directly into contact with one or more wheels, or using the equivalent of an automotive disc brake, i.e. bringing a brake pad into contact with another element which is connected to the wheel (as in an automotive disc brake). See U.S. Pat. No. 5,232,231 (Carlsmith) for an excellent general review of the prior art.

Most braking systems are actuated by changing the orientation of the foot, as is the case with heel brakes. However, other actuation means are known. For example, many patents involve the use of hand-actuated brake controls which lead to various braking means via cables which run down one or both legs of the skater. Examples are U.S. Pat. Nos. 182,835 (Lockwood), 1,801,205 (Mirick), 2,027,487 (Means), 2,140,955 (Goettie), 4,943,075 (Gates), 5,171,032 (Dettmer), 5,226,673 (Cech), and 5,251,934 (Gates).

Such cable arrangements achieve a highly desirable object, namely to permit braking while enabling the skater to keep all wheels still on the ground. However, in practice they are fundamentally impractical, since either the brake is not instanteously available, or the skater has to have a brake control held in his or her hand, which restricts freedom of movement, interferes with balance, and increases the possibility of injury during the inevitable falls.

It would be highly advantageous to have a braking system which permitted braking with all wheels still on the ground, but which did not require hand controls. Several rather old patents show early attempts to achieve this, but they were ineffective and impractical by today's standards. For example, U.S. Pat. Nos. 920,848 (Eubank), 1,402,010 (Ormiston) and 1,497,224 (Ormiston) all show straps which are adapted to buckle about the ankle of the skater, and which are connected to actuate the brake when the ankle is moved forwardly (Eubank) or rearwardly (both Ormiston patents) relative to the skate.

It follows that there is a need for a braking system which permits braking with all wheels remaining on the ground, but which does not require hand controls. At the same time, the system must readily lend itself to present in-line skate designs without major modifications to the overall structure.

SUMMARY OF THE INVENTION

It is an object of the invention to provide an improved braking system which permits braking with all wheels remaining on the ground, but which does not require hand controls.

Many modern in-line skates have a cuff or ankle portion which is pivotally connected to the boot or to an upward extension of the chassis, in the region of the skater's malleoli, for greater comfort and flexibility of movement. In the invention, it was realized that advantage could be taken of the relative movement between the cuff and the boot or chassis when the ankle is flexed, by using that movement to actuate a braking mechanism. In seeking an effective way to make use of that relative movement, it was realized that a cable arrangement could be used to advantage.

Accordingly, in the invention a cable attachment means is secured to the cuff at one of the pivot points, to rotate relative to the boot with rotation of the cuff. A cable is attached to the attachment means a short distance from the pivot point, and is routed to lead rearwardly from the lower edge of the plate and thence through a cable housing connected to the boot and chassis near the heel area, and thence forwardly to the area of the wheels. At least one brake assembly is connected to the cable and is configured such that braking action is initiated when the cable is pulled by rearward rotation of the cuff relative to the chassis/boot assembly.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION

Figure 1:
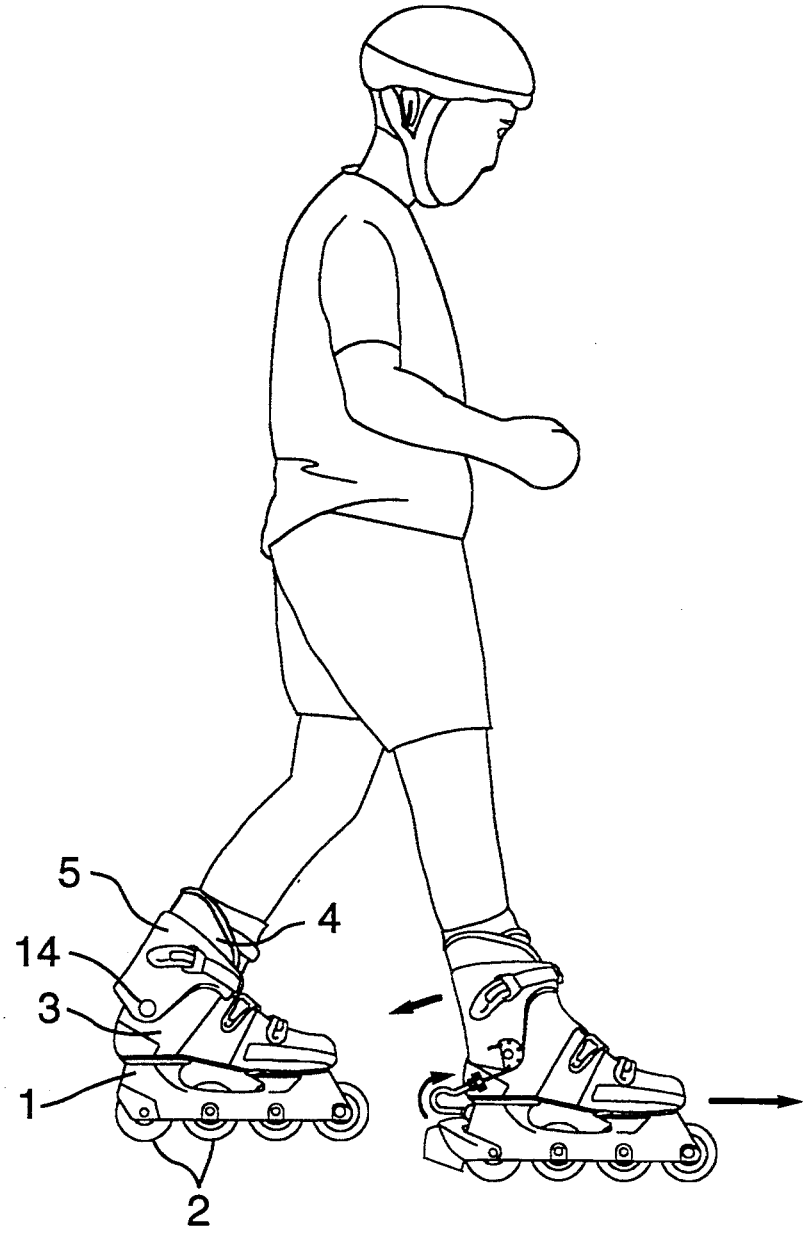
FIG. 1 is a side view of a skater pushing one of the skates of the preferred embodiment forward (i.e. rotating the ankle back) to activate the brake.
Figure 2:
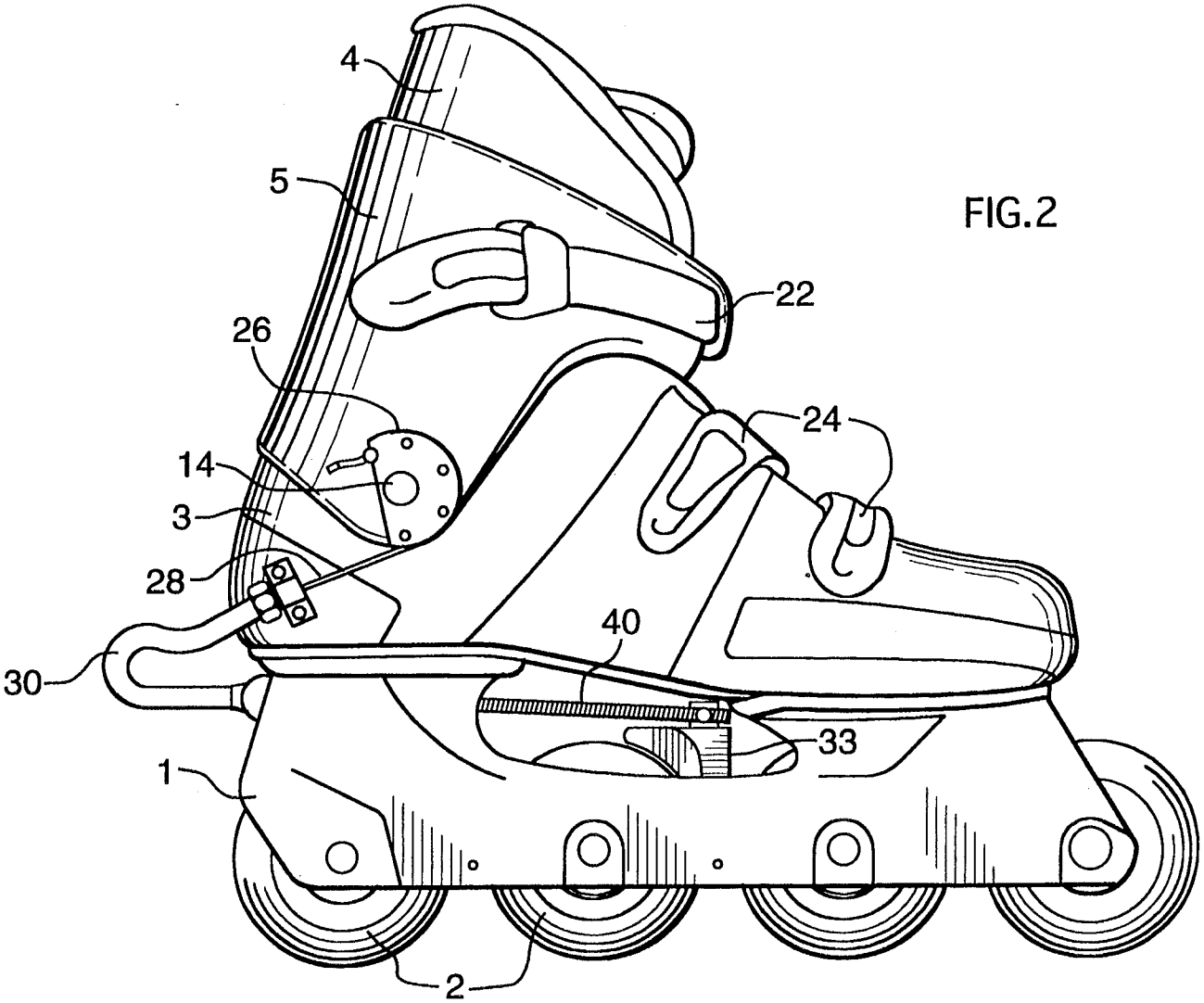
FIG. 2 is a side view of the preferred embodiment.
Figure 3:
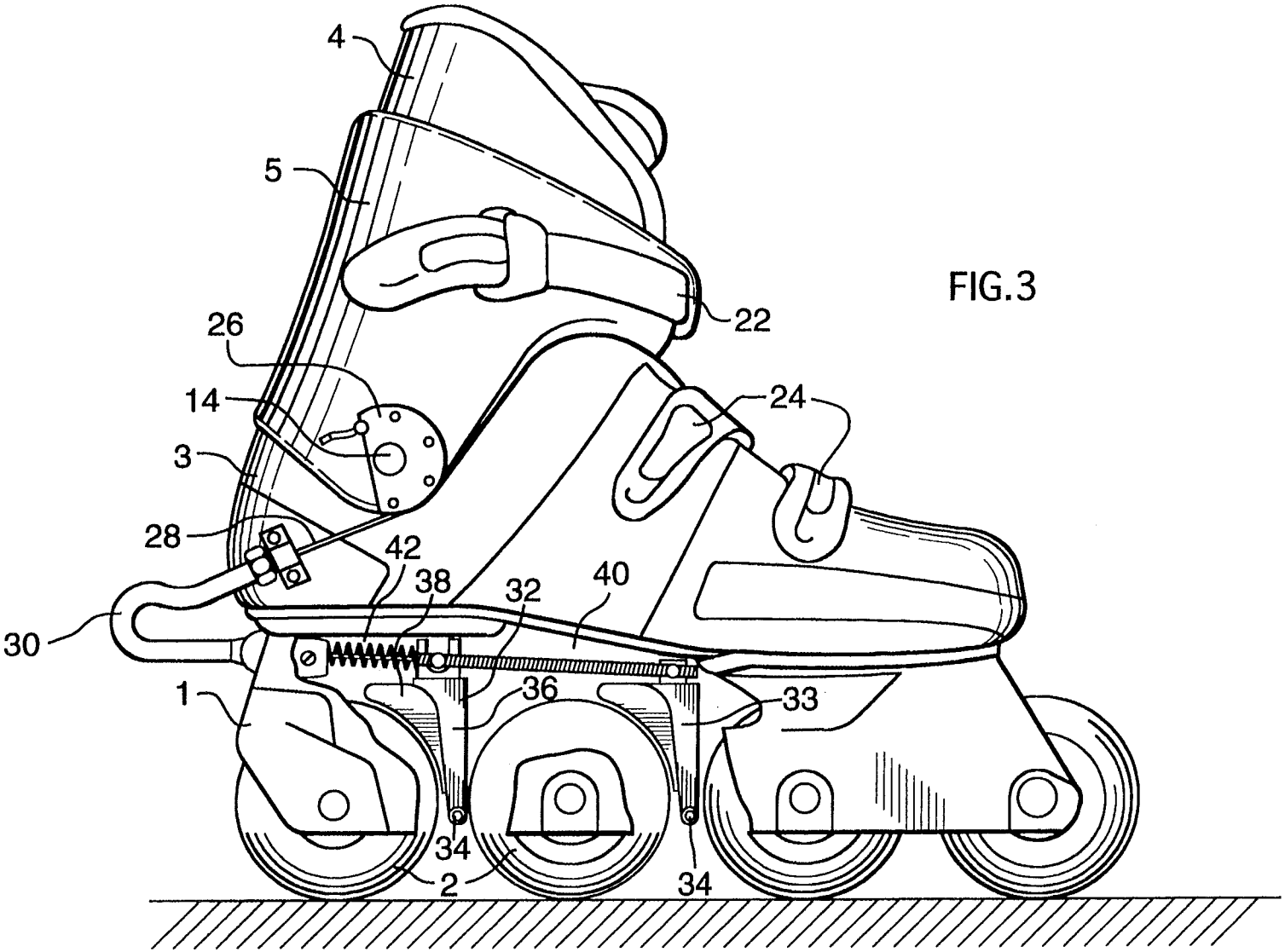
FIG. 3 is a side view similar to FIG. 2, but cut open to show the braking mechanism.

Referring now to FIGS. 1, 2 and 3 primarily, the main components of the skate are: a chassis 1, which carries wheels 2; a boot 3; a liner 4; and a cuff 5.

The liner 4 is a generally conventional flexible padded sock-like structure. The liner fits within the boot 3.

The cuff 5 is pivotally connected to the boot, or to upward extensions of the chassis, at pivot points 14. The pivot points are on lateral and medial sides of the skate, preferably in alignment with the user's malleoli, to permit dorsal/plantar flexion with minimal resistance.

Suitable straps are used to tighten the skate onto the user's foot, such as a cuff strap 22, and boot straps 24.

The above structures are conventional.

In the invention, a rigid plate 26, preferably having a cable guide channel (not shown) along its edge, is secured to the cuff at the lateral pivot point on one or both boots, to rotate relative to the boot, with rotation of the cuff. The plate may or may not be generally circular as shown in the drawings. A cable 28 is attached to the plate and is routed to lead rearwardly from the lower edge of the plate. The cable leads through a cable housing 30 connected to the boot and chassis near the heel area, and then forwardly under the boot and centrally along the chassis. As seen most clearly in FIG. 3, two brake assemblies, namely a rear brake assembly 32 and a forward brake assembly 33 are mounted between the side walls of the chassis, pivotable about pivot points 34 near the bottom of the chassis, to brake the two rear wheels. Each brake assembly includes a brake shoe 36 and a brake pad 38 which follows the contour of the wheels.

As can be readily seen from FIG. 3 in particular, rotating the cuff rearwardly as the skater in FIG. 1 is doing pulls on the cable, which in turn pulls on the rear brake assembly. The forward brake assembly is ganged to the rear brake assembly via a connecting rod 40. The cable thus pulls on both brake assemblies to rotate the brake pads into contact with the wheels.

A return spring 42 pushes forwardly on the brake assemblies sufficiently to keep the brake pads clear of the wheels when there is no tension on the cable.

A particular advantage of the invention is that when one wants to "put on the brakes" to slow down, putting one foot forward is a natural reaction, which is precisely what will put the brakes on. The farther the foot is put forward, the greater the braking power, which again is highly desirable. The result is very natural or "intuitive" braking.

It will be appreciated that the above description relates to the preferred embodiment by way of example only. Many variations on the invention will be obvious to those knowledgeable in the field, and such obvious variations are within the scope of the invention as described and claimed, whether or not expressly described.

It should be clear, for example, that the invention could be readily adapted to brake one, three, or more wheels if desired, instead of the two wheels illustrated here. The most effective braking will be at the rear wheels, however, since more of the skater's weight will naturally be borne at the rear wheels during braking.

It should also be clear that the specifics of the actual brake arrangement are not essential to the invention; what is essential is the cable arrangement actuated by the rotation of the cuff relative to the boot or chassis, and what form of brake that cable is connected to is to some extent irrelevant.

Figure 4:
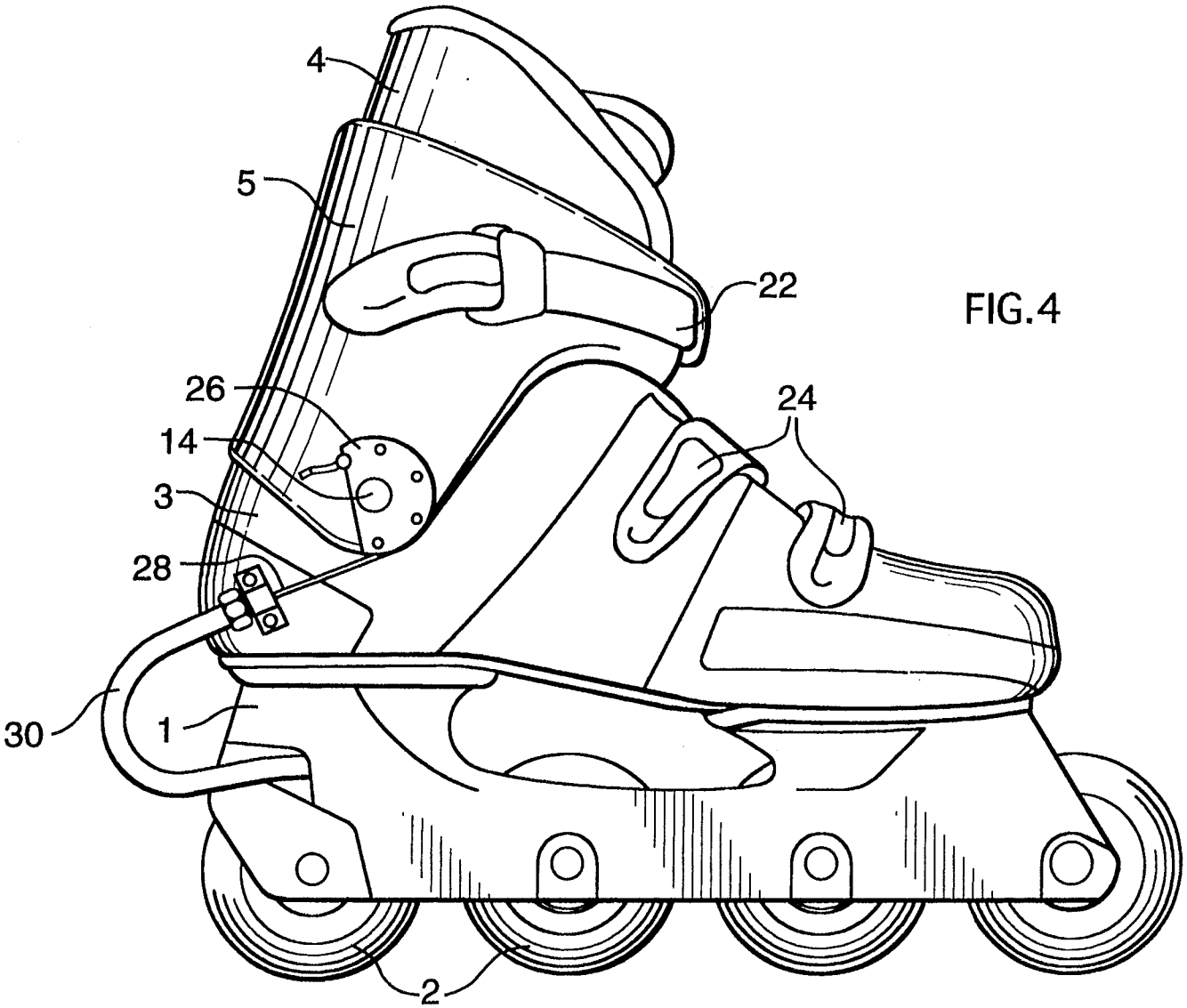
FIG. 4 is a side view of an alternative embodiment.
Figure 5:
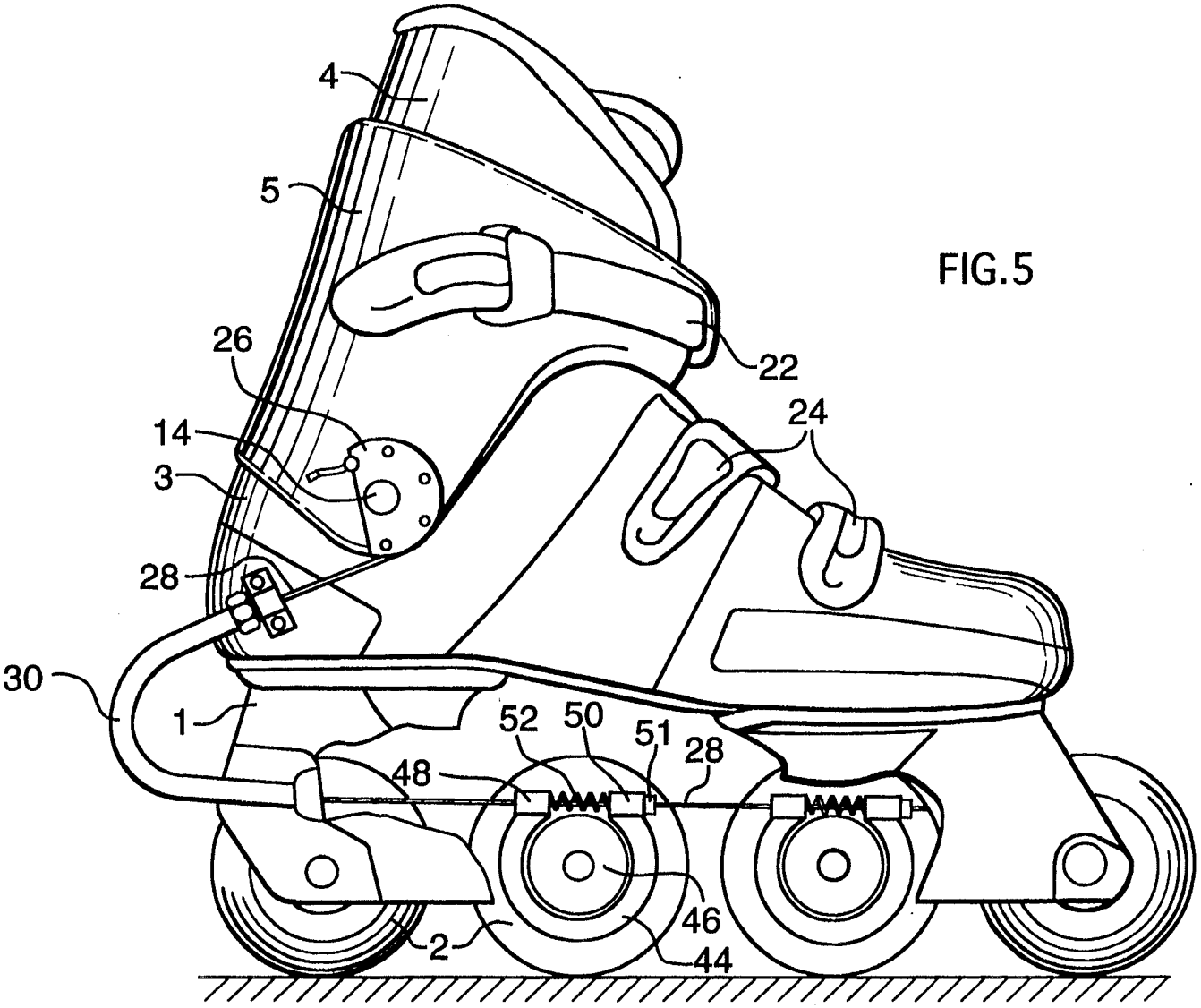
FIG. 5 is a side view similar to FIG. 4, but cut open to show the braking mechanism.

FIGS. 4 and 5 show a considerably different brake, for example. In that brake, a flexible horseshoe arrangement 44 wraps around a steel drum 46 built into the hub of the wheel, preferably on at least two wheels as illustrated. The horseshoe has a rear cable guide 48 which is fixed to the chassis, and a free end sleeve 50 restrained by an adjustment nut 51. Pulling the cable thus moves the sleeve 50 back towards the cable guide 48, causing a brake member within the horseshoe to come into contact with the drum 46. Return springs 52 keep the brake lining out of contact with the drum when the cable is not being pulled. The adjustment nuts 51 obviously permit adjustment of the point of onset of braking.

What is claimed as the invention is:

1. A braking system for an in-line skate, where said skate comprises a chassis and boot assembly carrying a plurality of in-line wheels, and a plastic cuff securable around a skater's ankle and pivotally connected to said chassis and boot assembly at lateral and medial pivot points generally in the area of the skater's lateral and medial malleoli respectively, said braking system comprising:

a cable attachment means secured to the cuff at one of said pivot points, to rotate relative to the boot with rotation of the cuff;

a cable attached at one end to said cable attachment means and routed to lead rearwardly from a lower edge thereof disposed a distance below said pivot point, thence through a cable housing connected to the chassis and boot assembly near a heel area thereof, and thence forwardly to the area of the wheels; and at least one brake assembly connected to said cable at an opposite end thereof to move a brake member connected to the chassis into engagement with a portion of at least one of the in-line wheels to provide a braking action initiated by said cable being pulled by rearward rotation of said cuff relative to said chassis and boot assembly.

2. A braking system as recited in claim 1, where each said brake assembly member is a brake pad positioned immediately forward of a wheel and having a arcuate inner surface facing said wheel and generally following the contour thereof.

3. A braking system as recited in claim 2, where there are at least two said brake members, namely one brake member on each of at least two separate wheels, and where said brake members are connected to each other by a substantially rigid connecting rod, whereby movement of said brake members is in ganged fashion.

4. A braking system as recited in claim 1, where each said brake assembly comprises a flexible horseshoe arrangement wrapping around a drum extending laterally from a wheel, said horseshoe arrangement having said brake member positioned therein and having a rear cable guide fixed to the chassis at one end of said horseshoe, and a free end sleeve forward of said rear cable guide at the other end of said horseshoe, restrained against forward movement by positioning means secured to said cable, such that pulling said cable moves said free end sleeve back towards said cable guide, thereby causing the brake member to come into contact with said drum, thereby producing braking action.

5. A braking system as recited in claim 4, further comprising a return spring between each said rear cable guide and the corresponding free end sleeve, to keep said brake lining out of contact with said drum when the cable is not being pulled.

6. A braking system as recited in claim 4, where each said positioning means is adjustable in position on said cable.

* * * * *